United States Patent [19]

Nishida

[11] 4,280,079

[45] Jul. 21, 1981

[54] DRIVING SYSTEM FOR A PLASMA DISPLAY PANEL

[75] Inventor: Kazunori Nishida, Tokyo, Japan

[73] Assignee: Nippon Electric Co., Ltd., Tokyo, Japan

[21] Appl. No.: 47,328

[22] Filed: Jun. 11, 1979

[30] Foreign Application Priority Data

Jun. 10, 1978 [JP] Japan ..... 53-70261
Nov. 10, 1978 [JP] Japan ..... 53-138679

[51] Int. Cl.[3] ..... H05B 37/00; H05B 41/00

[52] U.S. Cl. ..... 315/169.4; 340/779; 340/789

[58] Field of Search ..... 315/169.4, 169.1; 340/805, 811, 813, 776, 777, 779, 789, 166 R

[56] References Cited

U.S. PATENT DOCUMENTS

| | | | |
|---|---|---|---|
| 3,942,071 | 3/1976 | Krebs et al. | 340/813 |
| 4,091,309 | 5/1978 | Strom | 340/777 |
| 4,100,461 | 7/1978 | Hada et al. | 315/169.4 |
| 4,194,199 | 3/1980 | Shepherd et al. | 340/789 |

*Primary Examiner*—Alfred E. Smith
*Assistant Examiner*—Thomas P. O'Hare
*Attorney, Agent, or Firm*—Laff, Whitesel & Rockman

[57] ABSTRACT

Upon applying a discharge voltage between opposed electrodes of a plasma display panel, all electrodes other than a selected electrode are clamped at a fixed potential. To that end, a toggled voltage is supplied from a toggled voltage source and applied via a first switching circuit, to one ends of a plurality of second switching circuits in common. The other ends of the second switching circuits are respectively connected to panel electrodes and to one end of third switching circuits. The other ends of the third switching circuits are respectively held at a fixed potential. The second and third switching circuits may be driven synchronously in such manner that when one is ON, the other is OFF and vice versa when a toggled voltage is not brought to a panel electrode, that panel electrode is clamped at a fixed potential. Such a first switching circuit and a group of second switching circuits are combined into one set. There are provided a plurality of such sets, in which the other ends of the corresponding second switching circuits in the respective sets are connected in common, via blocking diodes, to one end of the corresponding third switching circuit. Thereby a compact switching matrix circuit can be formed. By means of the aforementioned driving circuit, generation of an induction voltage was prevented and the operating voltage range was broadened.

14 Claims, 16 Drawing Figures

(I) Vo G
(t1) H L
(t2) H L
(t5) H L
(Tλ1) H L
(Tλ2) H L
(Tλ11) H L
(P1) Vo G
(P2) Vo G
(P5) Vo G
(P6) Vo G
(P51) Vo G
(P55) Vo G
t
5t 5t
50t
(To1)
(To2)
(To10)
Vo
G t
(t1)
(t2)
(t5)
H
L (X6)
(X51)

(d1)

50t
(Ø1)
(Ø2)

(Y1)
(Y11)

(X6-Y1)
(X51-Y11)
-Vo

DRIVING SYSTEM FOR A PLASMA DISPLAY PANEL

BACKGROUND OF THE INVENTION

The present invention relates to a driving system for a plasma display panel, and more particularly to a driving system for an X-Y matrix type plasma display panel employing an alternate current (A.C.) driving system.

In one example of an A.C.-driven X-Y type plasma display panel, a plurality of parallel, thin, linear electrodes are densely formed on a pair of insulator plates comprising of transparent glass plates or the like, respectively. The surfaces of these linear electrodes are coated with a transparent dielectric film. These respective insulator plates are placed with spacers between them in an opposed relation, with a discharge space sandwiched therebetween, so that the respective linear electrode groups may cross each other at right angles, in a matrix form. The outer periphery of the discharge space is air-tightly sealed with flint glass, and after evacuation, inert gas such as neon is filled in the space. If an A.C. voltage is applied between a pair of electrodes selected respectively from the respective groups of linear electrodes, then gas discharge occurs at the cross-point between these selected electrodes, thereby effecting a desired luminescent display.

For applying an A.C. voltage, a method is known in which a scanning voltage is applied to either the row electrode or the column electrode and a signal voltage which corresponds to a signal to be displayed, is applied to the other electrode. For instance, if the scanning voltage is sequentially applied to the successive row electrodes, data voltages corresponding to the characters are simultaneously applied to the column electrodes.

It is one object of the present invention to provide a driving system having a broad operating voltage range to be used with a plasma display panel.

Another object of the present invention is to provide a driving system for a plasma display panel, which has a high reliability but which does not generate false firings even under aging effects.

Still another object of the present invention is to provide a driving system for a plasma display panel, in which a number of driving circuits can be reduced even when there are a large number of scanning electrodes.

According to one feature of the present invention, there is a driving system for a plasma display panel, in which an independent driving voltage is fed to each driving output terminal by means of a switching circuit commonly connected, via respective diodes, to a plurality of driving output terminals. The voltage is fed when the driven output terminal to be driven is not clamped at a fixed voltage.

According to one particular feature of the present invention, a driving system provides a type of plasma display panel which is constructed so that a pair of insulator plates having linear electrodes thereon, as coated with dielectrics, are disposed in an opposed relation. In this way, the linear electrodes on the respective insulator plates may cross each other and voltages having opposite polarities are applied to the individual electrodes on the respective insulator plates. This effects a gas discharge at the cross-points between said individual electrodes. A driving circuit comprises first and second NPN transistor groups each consisting mainly of NPN transistors. The first NPN transistor group is constructed in such manner that a base of a first NPN transistor is connected to the collector of the first transistor via a resistor. The emitter and base of the first transistor are connected through a first diode with the anode side of the first diode facing to the emitter side of the first transistor. The base of the first transistor is connected to an anode side of a second diode, and the cathode side of the second diode is connected to a collector of second NPN transistor. The second NPN transistor group is constructed in such manner that the collector of the second NPN transistor is connected to cathodes of a plurality of second diodes, and the emitter of the second transistor is grounded. A driving voltage applied to the collector of the first transistor is controlled by a signal applied to the base of the second transistor in order to derive the driving voltage from the emitter of the first transistor in response to said signal.

Figure 1:
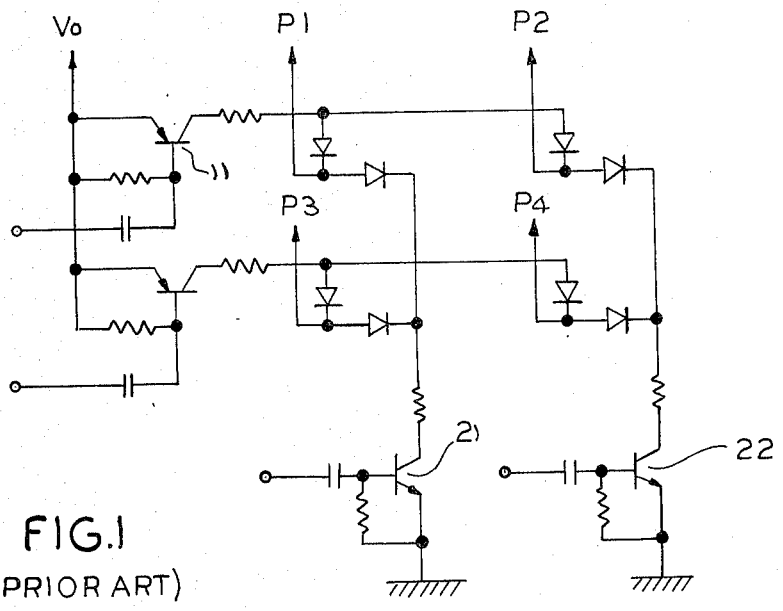
FIG.1 (PRIOR ART)
FIG. 1 is a circuit diagram for explaining a diode matrix circuit in the prior art.

Heretofore, in this type of display device, a diode matrix circuit (as disclosed in U.S. Pat. No. 4,100,461 assigned to the same assignee as this application) has been used as a scanning voltage generator circuit. An outline of a part of the diode matrix circuit is illustrated in FIG. 1.

In this figure, the emitters of PNP transistor 11 and NPN transistor 21 are connected to a D.C. power supply having a discharge voltage Vo and a ground potential, respectively. Identical toggled input signals are applied to the bases of the transistors 11 and 21, thereby alternately turning the transistor 11 and transistor 21 "ON" and "OFF" or "OFF" and "ON," respectively. As a result, the discharge voltage Vo and the ground potential can be alternately derived from an output terminal P1, which is connected via diodes to the collectors of the transistors 11 and 21, in response to the toggled input signal. Then, the other transistors are all held "OFF." In such a state the output terminal P1 has been selected.

When the transistor 11 is "ON," a potential at an output terminal P2 is clamped at discharge voltage Vo.

During the period when the transistor 11 is "OFF," the output terminal P2 is not brought to the ground potential because the transistor 22 is maintained "OFF." Since the output terminal P2 is "floating" with respect to the matrix circuit, an induction voltage is generated by a so-called "floating capacity," such as inter-line or inter-electrode capacities in the circuit and in the plasma display panel.

Accordingly, the potential at the output terminal P2 has a rippled voltage change which is determined by the discharge voltage Vo and the induction voltage. If such a rippled induction voltage and a data voltage are applied between opposed electrodes at a discharge dot, a false firing may possibly occur even at an unselected dot, depending upon the magnitude of the discharge voltage Vo (around 160 V). Therefore, such a diode matrix circuit has disadvantages because there is a narrow range of applied voltages which can provide a normal picture without generating a false firing. Thus, the operating voltage range becomes narrow. The aforementioned disadvantage leads to difficulties because one can hardly see the variations of a discharge voltage of a plasma display panel, becuase of the aging effects. Because of this, the device lacks reliability as a display.

DETAILED DESCRIPTION OF PREFERRED EMBODIMENTS

Figure 2:
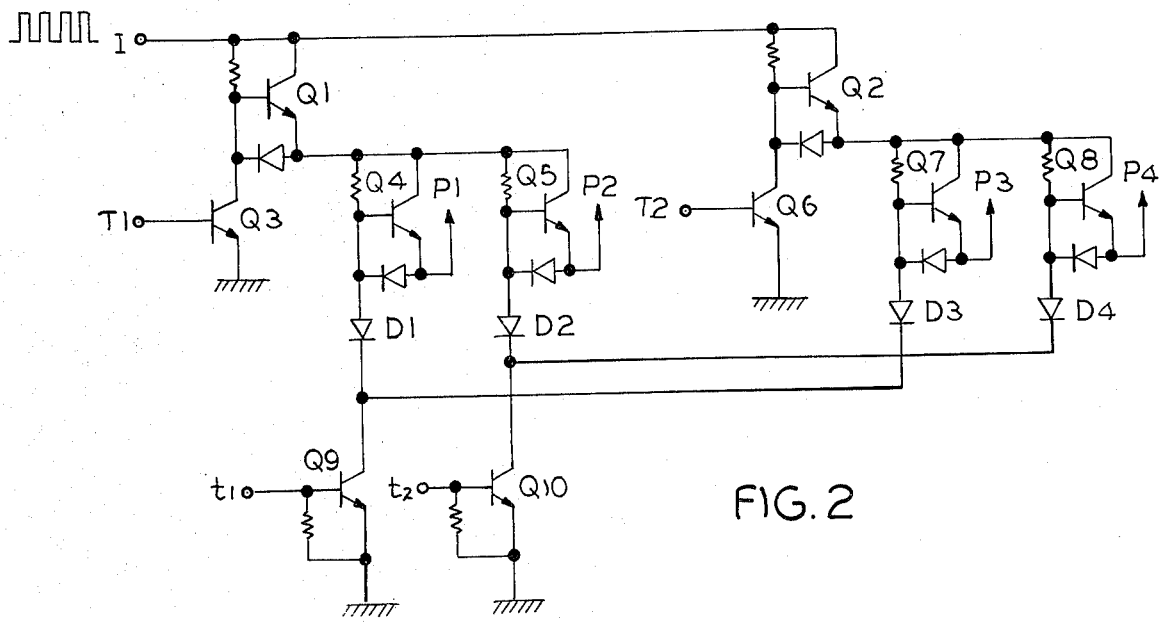
FIG. 2 is a circuit diagram for explaining the principle of the present invention with respect to the case of four output terminals.

Now, the principle of the present invention will be described with reference to FIG. 2. In this figure, reference characters $Q_1$ to $Q_{10}$ designate NPN transistors; characters $D_1$ to $D_4$ designate diodes for isolating the transistors $Q_4$ to $Q_8$ from each other, characters $T_1$, $T_2$, $t_1$ and $t_2$ designate input terminals for selecting one of output terminals P1 to P4; and character I designates an input terminal for a toggled voltage $V_t$ which is derived from a selected one of the ouput terminals P1 to P4 for driving the display panel.

At first, in order to derive the toggled voltage $V_t$ from only the output electrode or terminal P1, a low-level signal (L) is applied to the input terminal $T_1$ while a high-level signal (H) is applied to the input terminal $T_2$, to derive the toggled voltage $V_t$ from the emitter of a first switch or the transistor $Q_1$, while the emitter of the other first switch or transistor $Q_2$ is held at a fixed reference or ground voltage. At this moment, if a low-level floating signal is applied to the input terminal $t_1$ while a high-level floating signal is applied to the input terminal $t_2$, then a second switch or the transistor $Q_4$ is turned "ON" because a third switch or transistor $Q_9$ is turned to "OFF". The toggled voltage $V_t$ then appears at the output electrode or terminal P1. The diodes: $D_1$ and $D_3$ prevent interference between the output terminals P1 and P3. The output terminal $P_3$ is held at the emitter potential of the transistor $Q_2$, that is, at the ground potential. In addition, since the input terminal $t_2$ is at a high level, the transistor $Q_{10}$ is "ON", and accordingly the output terminals P2 and P4 are also held at the ground potential.

In order to derive the toggled voltage $V_t$ from the output terminal $P_4$, it is only necessary to apply a high-level signal to the input terminal $T_1$, a low-level signal to the input terminal $T_2$, a high-level signal to the input terminal $t_1$ and a low-level signal to the input terminal $t_2$. In a similar manner, the output condition at the output terminals P1 to P4 can be arbitrarily selected by adopting an appropriate combination of high and low levels at the input terminals $T_1$, $T_2$, $t_1$ and $t_2$.

In this way, non-selected output terminals can always be clamped at the ground level, as described above. Hence, the generation of induction voltages would not occur, as it does with a conventional driving circuit.

Figure 3:
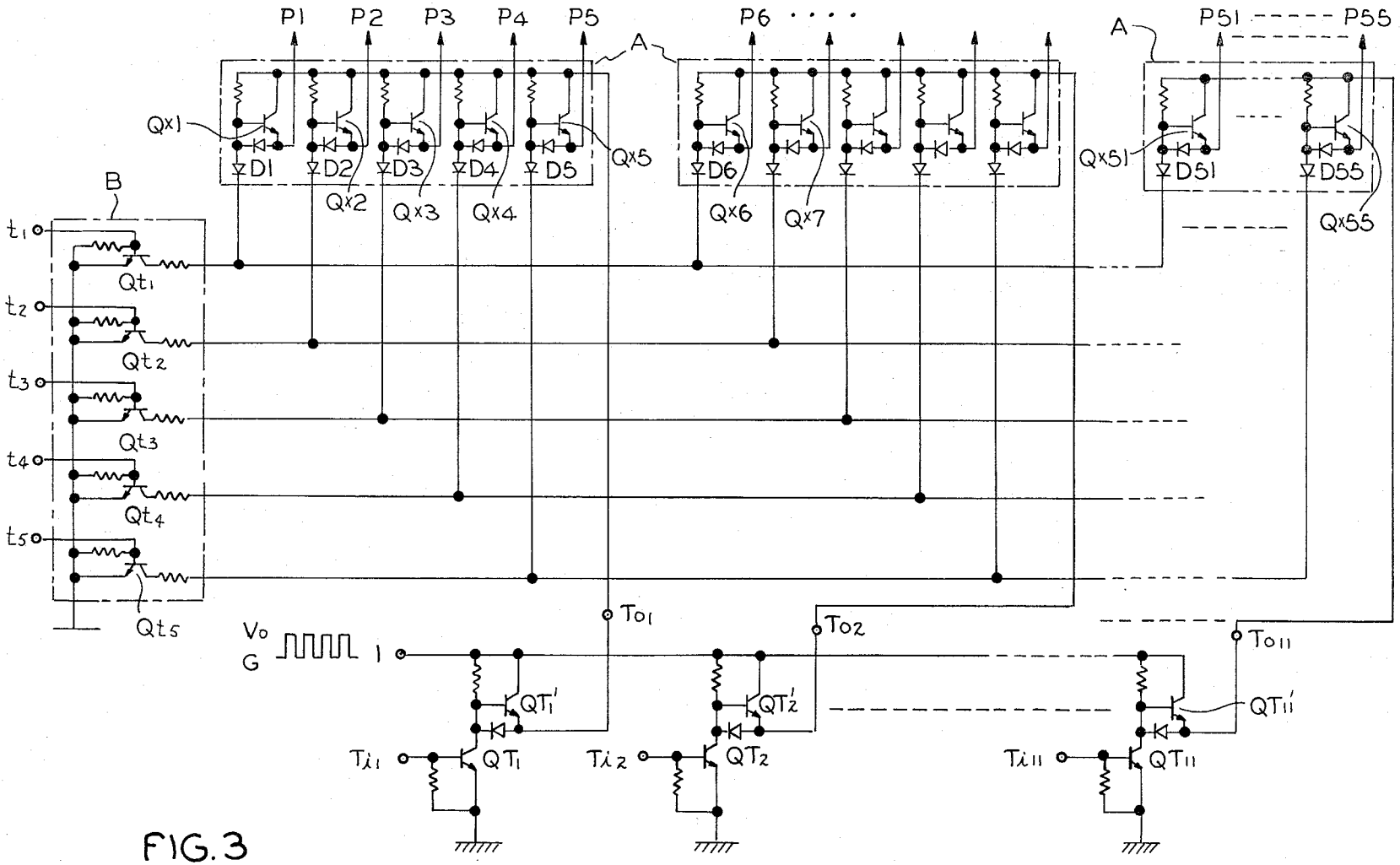
FIG. 3 is an equivalent circuit diagram of a driving circuit for column scanning electrodes in a display panel which comprises a row of eleven characters, each consisting of five columns of discharge dots according to one preferred embodiment of the present invention.

The following example of a driving system according to the present invention will refer to FIGS. 3 and 4 in order to explain column scanning electrodes in a display panel which comprises a row of eleven characters, each consisting of five columns of discharge dots. In FIG. 3, transistors $Q_{T1}$ and $Q_{T2}$ correspond to the transistors $Q_5$ and $Q_6$, respectively, in FIG. 2. In a similar manner, transistors $Q_{T1'}$ and $Q_{T2'}$ correspond to the transistors $Q_1$ and $Q_2$, transistors $Q_{X1}$ and $Q_{X2}$ to the transistors $Q_4$ and $Q_5$, transistors $Q_{t1}$ and $Q_{t2}$ to the transistors $Q_9$ and $Q_{10}$, and transistors $Q_{X6}$ and $Q_{X7}$ to the transistors $Q_7$ and $Q_8$, respectively.

Figures 4A, 4B, 4C, 4D:
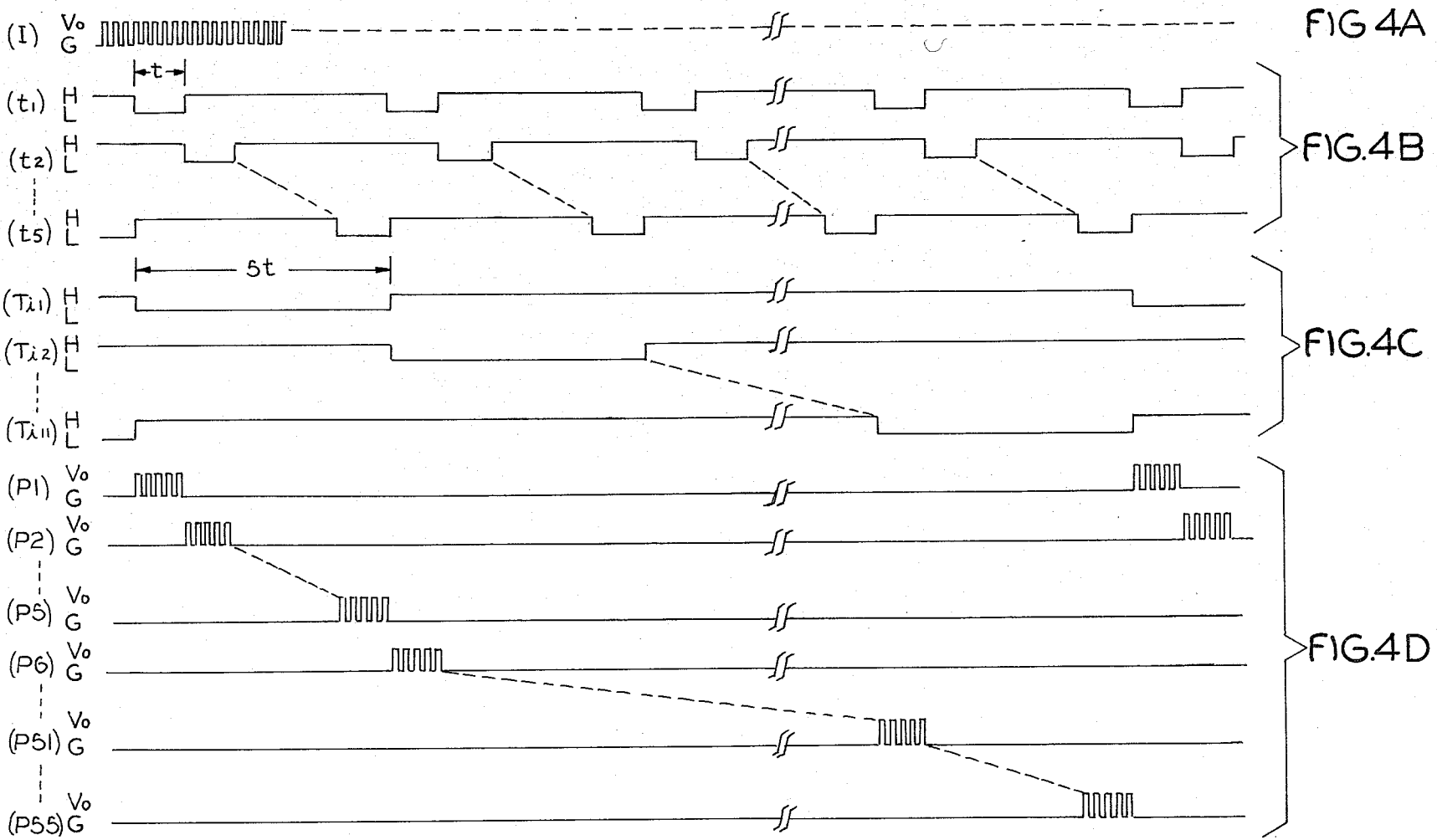
FIGS. 4A to 4D are time charts for the preferred embodiment illustrated in FIG. 3.

The time charts shown in FIGS. 4A to 4D illustrate, by way of example, the case where fifty-five ($5\times11$) output terminals P1 to P55 are sequentially selected. With reference to these figures, when the signal voltages are respectively applied to the input terminals I (FIG. 4A), $t_1$ to $t_5$ (FIG. 4B) and $T_{i1}$ to $T_{i11}$ (FIG. 4C), toggled voltages as shown in FIG. 4D are derived from the ouput terminals P1 to P55.

Both of the NPN transistors $Q_{t1}$ to $Q_{t2}$ are successively turned "OFF" for a time period of t by applying low-level signals to the signal input terminals $t_1$ to $t_5$. The applied low-level signals have a pulse width of t in successive phase relationships. These signals successively scan the NPN transistors $Q_{t1}$ to $Q_{t5}$, switching them "OFF". Other low-level signals, having a pulse width of 5t, are repeatedly applied to the signal input terminals $T_1$ to $T_{11}$. These signals successively scan the NPN transistors $Q_{t1}$ to $Q_{t11}$, switching them "OFF". More particularly, the operation is such that during only the first scanning for the transistors $Q_{t1}$ to $Q_{t5}$ is the transistor $Q_{T1}$ turned "OFF", during only the second scanning for the same transistors $Q_{t1}$ to $Q_{t5}$ is the transistor $Q_{T2}$ turned "OFF", and so on.

The respective collectors of the transistors $Q_{T1'}$ to $Q_{T11'}$ are commonly connected to the input terminal I, whereto the toggled voltage $V_t$ is applied. The toggled voltage $V_t$ alternately takes the discharge voltage $V_o$ and the ground level G as shown at (I) in FIG. 4A.

At first, in order to output the waveform shown at (P1) in FIG. 4D at the output terminal P1, a low-level signal is applied to the terminal $t_1$ while high-level signals are applied to the terminals $t_2$ to $t_5$, and a low-level signal is applied to the terminal $t_{i1}$ as synchronized with the low-level signal at the terminal $t_1$. At the same time, high-level signals are respectively applied to the terminal $T_{i2}$ to $T_{i11}$. In response to the aforementioned input signals, only the transistors $Q_{t1}$ and $Q_{T1}$ are turned "OFF." Hence, the transistors $Q_{T1'}$, $Q_{X1}$, $Q_{X6}$, $Q_{X11}$, . . . , $Q_{x51}$ are turned "ON". Accordingly, the applied toggled voltage $V_t$ at the input terminal I is passed from the emitter of the transistor $Q_{T1'}$ through the collector-emitter path of the transistor $Q_{X1}$ and is derived from the output terminal P1. The duration of the output signal is determined by the period t of the low-level signal applied to the terminal $t_1$. It is to be noted that although the transistors $Q_{X6}$, $Q_{X11}$, . . . , $Q_{X51}$ are also turned "ON", the output terminals P6, P11, . . . , P51 are held at the ground potential. This occurs both because the output terminals P6, P11, . . . , P51 are blocked from the output signal at the output terminal P1 by means of the diodes D6, D11, . . . , D51, and because the transistors $Q_{T2}$ to $Q_{T11}$ are held "ON". In addition, since the transistors $Q_{t2}$ to $Q_{t5}$ are all held "ON", all the output terminals other than the output terminal P1 are, after all, held at the ground level.

Secondly, in order to derive the toggled voltage $V_t$ from the output terminal P2, it is only necessary to apply high-level signals to the input terminals $t_1$ and $t_3$ to $t_5$ and to apply a low-level signal to the input terminal $t_2$. At this moment, the output potential at the output terminal P1 is held at the ground level. Since the transistor $Q_{t2}$ is turned "OFF", the transistor $Q_{X2}$, which has been "OFF" up to this moment, is turned "ON". Furthermore, an output signal can be generated at the output terminal P6 by applying low-level signals to the input terminal $t_1$ and $T_{i2}$, and high-level signals to the input terminals $t_2$ to $t_5$, $T_{i1}$ and $T_{i3}$ to $T_{i5}$, respectively.

As understood from the above operation, the toggled voltage $V_t$ is only derived from one output terminal while the other output terminals are all held at the ground level. This enables a resolution of the problem of generating induction voltages, and broadening the operating voltage range. For instance, in the heretofore known driving circuit employing a diode matrix, the operating voltage range for a display panel comprising eleven characters in each row was about 20 V (155 V–135 V) whereas, according to the present invention, it has been greatly broadened to 40 V (175 V–135 V).

Figure 5A:
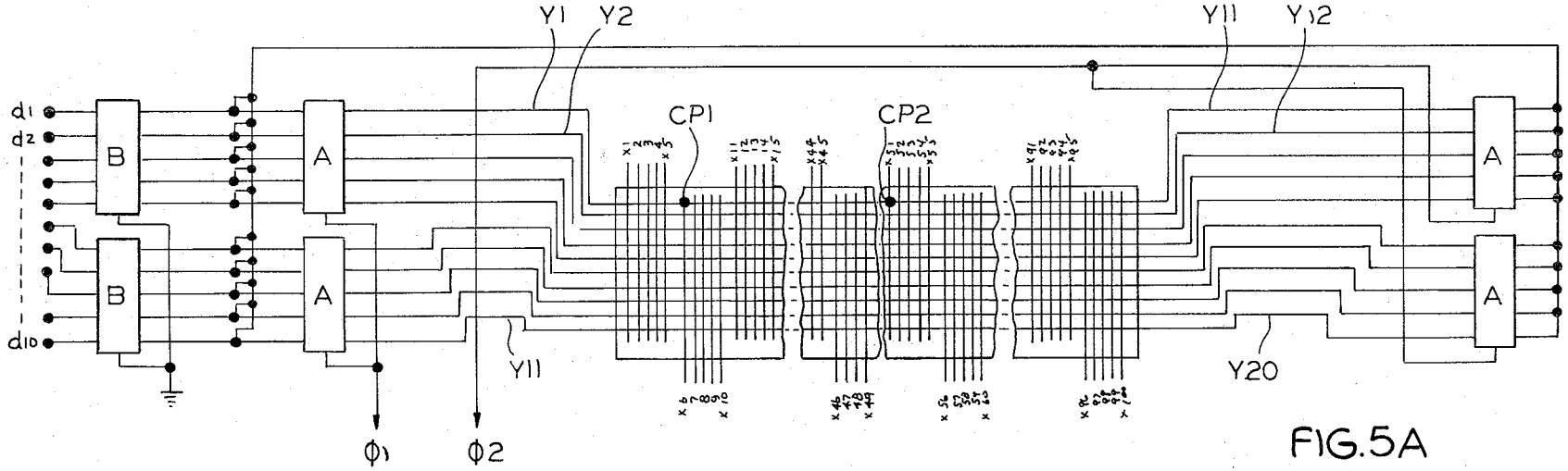
FIG. 5A shows, in combination, a schematic plan view of a matrix or orthogonal electrode array in a display panel which comprises a single row of twenty characters, each consisting of a ten rows×five columns array of discharge dots, and a block diagram of a driving circuit for data electrodes which is also constructed according to the present invention.
Figure 5B:
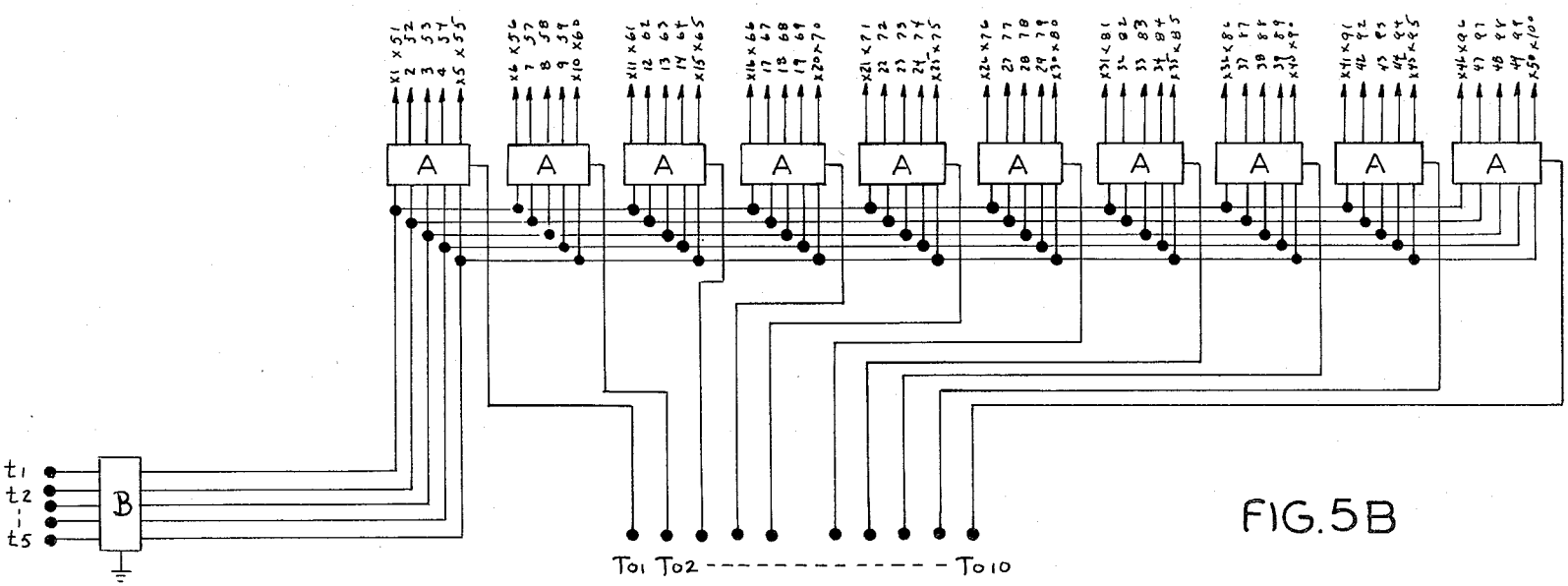
FIG. 5B shows a block diagram of a driving circuit for scanning electrodes in the display panel illustrated in FIG. 5A.

FIGS. 5A and 5B illustrate another preferred embodiment of the present invention, as applied to a driving circuit for scanning electrodes, as well as to a driving circuit for data electrodes, in a plasma display panel which comprises a single row of twenty characters, each of which consists of a ten rows × five columns array of discharge dots.

As shown in FIG. 5A, the row electrodes in the plasma display panel are separated severed into two sections at the center, thereby forming a plurality of orthogonal arrays or matrices. The respective sections of the electrodes are led out from the left and right edges of the plasma display panel. In this circuit diagram, blocks A and B are used for simplicity of the diagram. These blocks represent the circuit portions encircled by single-dot chain line frames A and B, respectively, in FIG. 3. This driving circuit employs the method for selecting desired dots by connecting a column electrode X1 to a column electrode X51, a column electrode X2 to a column electrode X52, and so on until a column electrode X50 is connected to a column electrode X100. The outputs of each block A are used for two column electrodes, and input data signals $d_1$ to $d_{10}$ are distributed to row electrodes Y1 to Y10 for the ten left-side characters, and to row electrodes Y11 to Y20 for the ten right-side characters.

Accordingly, for the column electrode scanning circuit, only ten blocks A and the single block B suffice. On the other hand, for the electrodes Y1 to Y10 and the electrodes Y11 to Y20, four blocks A are required, that is, two groups of two blocks A, with the respective groups being connected in common to two blocks B. Terminals $T_o1$ to $T_o10$ connected independently to the respective blocks A in FIG. 5B, correspond to the terminals $T_{o1}$ to $T_{o11}$ in FIG. 3 with only the terminal $T_{o11}$ removed. Accordingly, as will be apparent from FIG. 4C, toggled voltages having a duration 5t and a peak value $V_o$ are repeatedly applied to the respective terminals $T_o1$ to $T_o10$, at a period of 50t in a successive phase relation-ship. In addition, terminals $t_1$ to $t_5$ of a block B, connected in common to the respective block A, correspond to the terminals $t_1$ to $t_5$ in FIG. 3. Hence, it can be readily seen that by applying the input signals shown in FIGS. 4B and 4C, respectively, to the terminals $t_1$ to $t_5$ and the terminals To1 to To10, the toggled voltage is successively generated with a duration t at the column electrodes X1 to X50 and at the column electrodes X51 to X100.

Figures 6A, 6B, 6C, 6D, 6E, 6F, 6G:
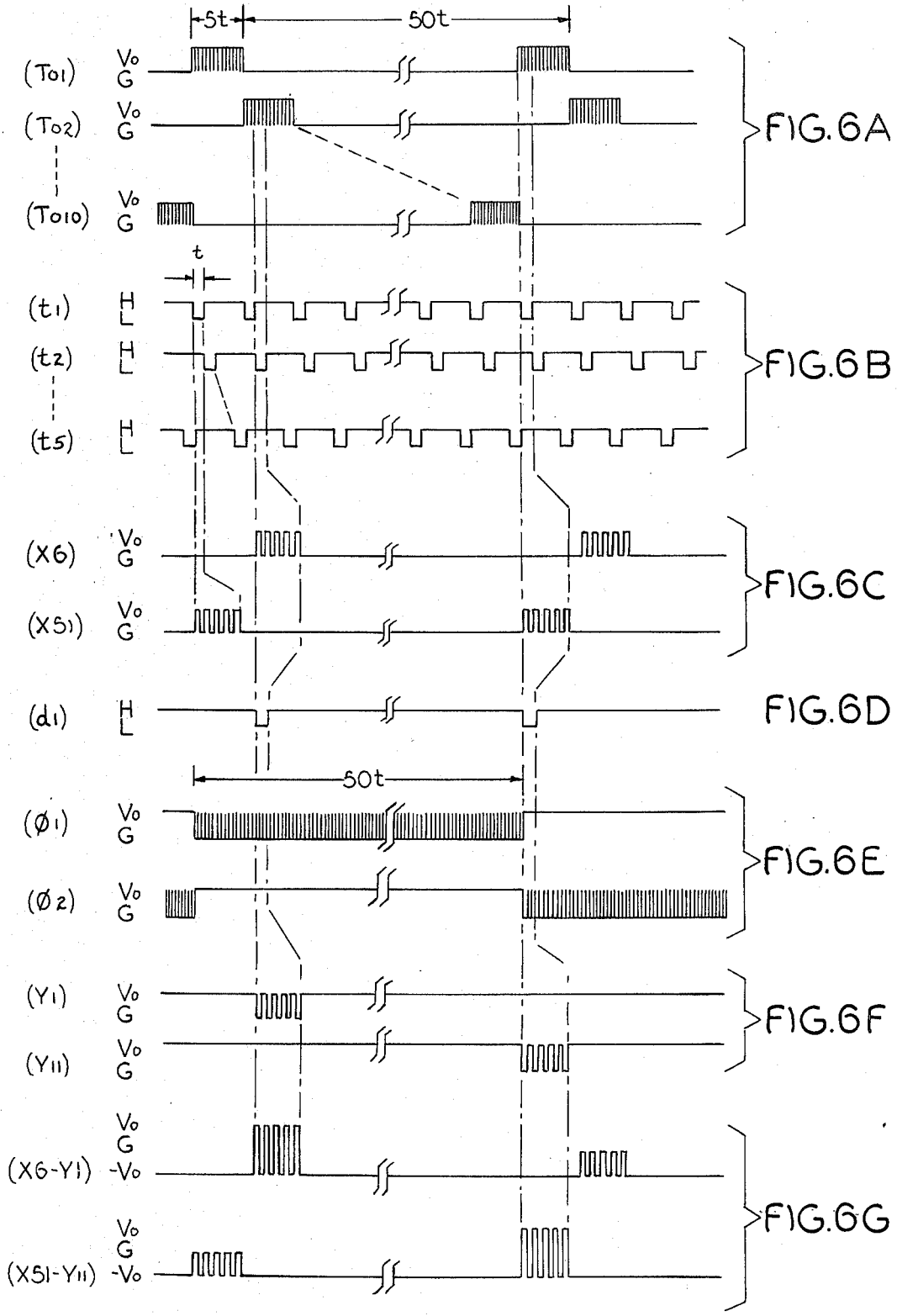
FIGS. 6A to 6G are time charts showing input waveforms appearing at various points in the circuit shown in FIGS. 5A and 5B.

For convenience of illustration, the time (horizontal) axis in FIG. 6A is reduced in scale by a factor of 1/5 with respect to the time axis in FIGS. 4A to 4D. Moreover, for the purpose of clarifying the timing relation between the toggled voltage in FIG. 6A and the input waveforms at the input terminals $t_1$ to $t_5$, the time axis in FIG. 6B is also reduced in scale by a factor of 1/5 with respect to the time axis in FIG. 4B. As examples of the output waveforms on the column electrodes X1 to X50 and X51 to X100, waveforms appearing on the column electrodes X6(X56) and X51(X1) are illustrated in FIG. 6C. FIG. 6C and FIG. 4D are depicted on the same scale of time axis. As will be seen from these figures, a toggle X-driving voltage has a duration t. A period 50t appears repeatedly on the column electrode X6(X56) as controlled by the waveform at the terminal To2 and the timing signal at the terminal $t_2$, and on the column electrode X51(X1) as controlled by the waveform at the terminal To1 and the timing signal at the terminal $T_1$.

At first, in order to make the cross-point CP1 (FIG. 5A) between the linear electrodes X6 and Y1 fire, pulses having a polarity opposite to the polarity of toggled X-driving voltage applied to X-electrode (column electrodes) are also applied to the row electrode Y1, as synchronized with the timing when the toggled X-driving voltage shown in FIG. 6C appears on the column electrode X6. To that end, toggled voltages $\phi_1$ and $\phi_2$ (FIG. 6E) having a polarity opposite to the polarity of the toggled voltage $V_t$ in FIG. 4A and a duration 50t are alternately applied to the blocks A connected to the electrodes Y1 to Y10 and to the other blocks A connected to the electrodes Y11 to Y20. In this way, the toggled Y-driving voltage may be applied to the electrode Y1 during only the period synchronized with the toggled X-driving voltage on the electrode X6.

Accordingly, a low-level signal is applied to the data input terminal $d_1$ for the block B (which terminal corresponds to the electrode Y1 as synchronized with a low-level signal at the terminal $t_2$ which is in turn synchronized with the toggle driving voltage on the column electrode X6 as shown in FIG. 6D). Then, a toggled Y-driving voltage having both a polarity opposite to the polarity to the toggled X-driving voltage on the column electrode X6 and a duration t, appears on the electrode Y1 as shown in FIG. 6F. Therefore, the potential difference between the electrodes X6 and Y1 becomes 2 $V_o$. Thus, a visible discharge will occur at the cross-point CP1 (FIG. 6G). At this moment, although the electrode X56 also receives the same toggled X-driving voltage that was applied to the electrode X6, the toggled voltage $\phi_2$ applied to the opposite electrode Y11 is held at a fixed level $V_o$. Therefore, a visible discharge will not occur at the cross-point between the column and row electrodes X56 and Y11.

The toggled pulses in FIGS. 6E and 6F are illustrated as being of a polarity which is opposite the polarity applied to the toggled pulses in FIG. 6A. However, even if they are of the same polarity, a similar result can be octained by shifting the toggle pulses in FIGS. 6E and 6F by one pulse width (t/10). Then the output pulses shown in FIG. 6G will be pulses swinging, between $V_o$ and $-V_o$, about the ground level G.

Now, in order to fire the cross-point CP2 (FIGS. 5A) which lies between the electrodes X51 and Y11 as in the above-described operation, it is only necessary to apply pulses to the row electrode Y11. Those pulses should have a polarity which is opposite that of the toggled X-driving voltage, and should be synchronized with the time period when the toggled X-driving voltage shown in FIG. 6C, appears on the column electrodes X51 and X1. Then, the cross-point between the column electrode X1 and the row electrode Y1 does not fire, because, as previously described, the row electrode Y1 is held at a fixed potential ($V_o$), at this moment.

In the circuit construction according to the present invention, the unselected panel electrodes are always held at the ground level. Thus, the previously described problem of generating induction voltages has been resolved, and a broad operating voltage range has been realized. For instance, in the heretofore known driving circuit, mainly consisting of a diode matrix, an operating voltage range for a display panel comprising a single row of twenty characters is about 15 V, whereas according to the above-described embodiment of the present invention, it is greatly broad-ended, up to 40 V.

Therefore, the present invention, realizes, a broad operating, driving voltage range, a high durability against effects, and a high reliability, each of which is described above. Moreover, by manufacturing the five circuits represented by blocks A and B in FIG. 3 in a hybrid IC, additional practical advantages can be obtained. The labor cost is reduced, the reliability is enhanced, and the space occupied by the circuit is reduced with respect to the conventional diode matrix circuit.

In connection with the above-discussed operation of the driving circuit, it is necessary to take the following points into consideration. First, to provide a non-flickering display utilizing a time division drive, it is necessary to refresh each electrode of the group involved with a voltage pulse train having a frequency in the order of 50 Hz or more. The repetition frequency of the low-level signal applied to the terminals $T_{i1}$ to $T_{i10}$ should therefore be 5 KHz (50 Hz×100 columns) or more in FIG. 5. Second, to provide a sufficiently bright display, it is necessary to supply each electrode of the relevant group with 2000 or more pulses during each second. The repetition frequency of the pulse train of the toggled voltage $V_t$ should therefore the approximately 200 KHz (2 KHz×100 columns) or more in FIG. 5. It has been confirmed that the embodiment illustrated in FIG. 5 is stably operable at a frequency as high as 500 KHz. When the frequency of the toggled voltage $V_t$ is 500 KHz, a sufficient brightness requires 20 microseconds or more of t in FIG. 6. This insures brightness because the number of pulses applied to each column electrode at one time is ten or more. For a non-flickering display, on the other hand, the upper limit of the above period t is 200 microseconds at operation of 500 KHz.

What is claimed is:

1. A driving system for a plasma display wherein a pair of insulator plates have a plurality of electrodes thereon, coated with dielectic layers, said plates being disposed in an opposed relationship with a gas discharge medium sandwiched therebetween, said system comprising:

a. a first switching means for passing a toggled voltage from one end of said first switching means to the other end thereof;

b. a plurality of a second switching means commonly connected to said other end of first switching means, for passing said toggled voltage to a selected one of said electrodes; and c. a plurality of third switching means respectively connected to said electrodes for clamping all of said electrodes at other than said selected one electrode at a fixed potential.

2. A system for a plasma display comprising a plurality of spaced parallel thin linear electrodes densely formed in an orthogonal array of cross-points in spaced parallel planes separated by a gas discharge medium, means for sequentially applying a toggled voltage to one end of at least a selected one of said electrodes, the selection being on a basis wherein a cross-point of said selected electrodes form at least part of a predetermined display, whereby a gas discharge at selected cross-points form a display, and means for applying a clamping potential to each non-selected one of said electrodes to preclude a gas discharge to said non-selected electrode.

3. The system of claim 2 wherein said parallel planes are surfaces of transparent plates.

4. The system of claim 2 wherein said toggled voltage applying means comprises a first plurality of parallel connected electronic switch means connected between a common input terminal marked by said toggled voltage and individually associated ones of said electrodes, and said clamping means comprises other electronic switch means connected between said first parallel switches and a source of said clamping potential, and means for selectively controlling said other electronic switch means to remove said clamping voltage at selected electrodes whereby said toggled voltage is applied through the individually associated one of said first electronic switch means to said selected electrodes.

5. The system of claim 4 and isolation gate means positioned between said electronic switch means to prevent interaction between said electrodes via feedback through said electronic switch means.

6. The system of claim 5 wherein there are a plurality of said orthogonal arrays, each of said arrays having individually associated ones of said toggle voltage-applying means and said clamping means.

7. The system of claim 6 wherein those of said electrodes which extend in one direction are periodically divided to form separate ones of said arrays.

8. The system of claim 6 wherein there are a plurality of said toggled voltages which have phase differences, each of said phases being individually associated with a corresponding one of said arrays, whereby said has discharge occurs with different phases in said orthogonal arrays.

9. The system of claim 5 wherein said clamping potential is system ground.

10. A process for making a gas discharge display in any one of many preselected geometrical forms, said process comprising the steps of:

a. establishing capacitive cross-points in a pattern which may be selectively excited to establish any of said preselected forms, each of said capacitive cross-points having a gas insulator which breaks down under electrical stress to form a flow discharge;

b. clamping said capacitive cross-point at a potential which precludes the electrical stress that forms said flow discharge;

c. applying a toggle voltage to stress said cross-points; and d. selectively removing said clamping potential at only those of said cross-points which form any selected one of said geometrical forms, whereby the toggle voltage at the unclamped cross-points causes a glow discharge to appear thereat.

11. The process of claim 10 and the added step of separating said cross-points into individual arrays whereby each of said arrays may form a separate geometrical display.

12. A driving system for a plasma display wherein a pair of insulator plates have a plurality of electrodes thereon, coated with dielectric layers, said plates being disposed in an opposed relationship with a gas discharge medium sandwiched therebetween, said system comprising a drive voltage supply terminal, a ground terminal, a plurality of first nodes, a plurality of first switching means coupled respectively to said first nodes, means for controlling said first switching means to connect selected one of said first nodes to said drive voltage supply terminal and the other first nodes to said ground terminal, a first number of groups of second switching means, each group including said first number of second switching means, said groups being respectively coupled to said first nodes, said second switching means being respectively connected to said electrodes, means for controlling said second switching means to connect the selected ones of electrodes from the respective groups to the respective first nodes assigned to the respective groups and the other electrodes to said ground terminal, whereby one of the selected electrodes connected to said selected one of the first nodes is connected to said drive voltage supply terminal and the other selected electrodes connected to said other first nodes are connected to the ground terminal.

13. A system for a plasma display comprising a plurality of spaced parallel thin linear electrodes densely formed in an orthogonal array in spaced parallel planes separated by a gas discharge medium, a first switching means for selectively switching between a toggled drive voltage and a fixed reference voltage, a plurality of a second switching means having first, second and third terminals, said first terminals being commonly connected to said first switching means, said second terminals being respectively connected to said electrodes, and a plurality of a third switching means for selectively switching between a fixed reference voltage and a floating potential, said third switching means being respectively connected to said third terminals of said second switching means, the second switching means being connected to the third switching means when switched to said floating potential for connecting the electrodes connected thereto to said first switching means, the second switching means being connected to the third switching means when switched to said fixed reference voltage for connecting the electrodes connected thereto to said fixed reference voltage, the electrode being connected to said first switching means by means of said second switching means and supplied with said toggled drive voltage when said first switching means is switched to supply said toggled drive voltage and with said fixed reference voltage when the first switching means is switched to said fixed reference voltage.

14. A plasma display device comprising a pair of insulator plates having a plurality of electrodes thereon, coated with dielectric layers, said plates being disposed in an opposed relationship with a gas discharge medium sandwiched therebetween; a drive voltage supply terminal, a ground terminal, a plurality of first nodes; a plurality of first control terminals, a plurality of second control terminals; a plurality of first transistors coupled respectively between said drive voltage supply terminal and the respective first nodes; a plurality of first control means respectively coupled to said ground terminal, said first nodes, said first control terminals and said first transistors; said first control means turning the first transistor coupled thereto "ON" in response to a first state at the first control terminal coupled thereto; said first control means connecting the first node coupled thereto to said ground terminal in response to a second state at said first control terminal; a plurality of second transistors coupled respectively to said electrodes, said second transistors being divided into a plurality of groups, said second transistors in the respective groups being coupled in common to the respective first nodes; and a plurality of second control means respectively coupled to said ground terminal, second nodes, said second control terminals, said second transistors, and said electrodes; said second control means enabling current to flow through the second transistor coupled thereto, said current flow being between the electrode and the first node coupled to the fast-mentioned second transistor in response to a first state at said second control terminal; and said second control means connecting the electrode coupled thereto to said ground terminal in response to a second state at said second control terminal.

* * * * *

UNITED STATES PATENT AND TRADEMARK OFFICE

CERTIFICATE OF CORRECTION

PATENT NO. : 4,280,079

DATED : July 21, 1981

INVENTOR(S) : KAZUNORI NISHIDA

It is certified that error appears in the above—identified patent and that said Letters Patent is hereby corrected as shown below:

SPECIFICATION:

Col. 1, Line 13, after "comprising", delete "of";

Col. 1, Line 37, insert --summary of the invention-- on separate line;

Col. 1, Line 54, delete "to be driven";

Col. 4, Line 34, "Qtl to Qtll" should be --QTl to QTll--;

Col. 4, Line 49, ""til" should be --Til--;

Col. 5, Line 54, after "only" insert --the--;

Col. 6, Line 65, "octained" should be --obtained--;

Col. 7, Line 26, after "against" insert --aging--;

Col. 7, Line 46, after "therefore" "the" should be --be--.

ABSTRACT OF DISCLOSURE:

Line 6, "ends" should be --end--;

Line 14, after "verse", "when" should be --. When--.

UNITED STATES PATENT AND TRADEMARK OFFICE

CERTIFICATE OF CORRECTION

PATENT NO. : 4,280,079

DATED : July 21, 1981

INVENTOR(S) : KAZUNORI NISHIDA

It is certified that error appears in the above—identified patent and that said Letters Patent is hereby corrected as shown below:

CLAIMS:

Claim 8, Line 4, "has" should be --gas--;

Claim 14, Line 29, "Fast" should be --last- --.

Signed and Sealed this

*Eighth* Day of *December 1981*

[SEAL]

*Attest:*

GERALD J. MOSSINGHOFF

*Attesting Officer* *Commissioner of Patents and Trademarks*